US009603496B1

(12) United States Patent
Hartman

(10) Patent No.: US 9,603,496 B1
(45) Date of Patent: Mar. 28, 2017

(54) TOILET SEAT ASSEMBLY

(71) Applicant: David C. Hartman, Saranac, MI (US)

(72) Inventor: David C. Hartman, Saranac, MI (US)

( * ) Notice: Subject to any disclaimer, the term of this patent is extended or adjusted under 35 U.S.C. 154(b) by 223 days.

(21) Appl. No.: 14/158,143

(22) Filed: Jan. 17, 2014

Related U.S. Application Data

(60) Provisional application No. 61/791,756, filed on Mar. 15, 2013.

(51) Int. Cl.
*A47K 13/00* (2006.01)

(52) U.S. Cl.
CPC ..... *A47K 13/00* (2013.01)

(58) Field of Classification Search
CPC ..... A47K 13/00
USPC ..... 4/237–241
See application file for complete search history.

(56) References Cited

U.S. PATENT DOCUMENTS

| | | | | |
|---|---|---|---|---|
| 1,927,453 | A | 9/1933 | Hill | |
| 2,513,444 | A | 7/1950 | Barnes | |
| 2,517,755 | A | 8/1950 | Yumoto | |
| 2,891,538 | A | 6/1959 | Moxley | |
| 2,894,505 | A | 7/1959 | Manausa | |
| 2,943,621 | A | 7/1960 | Phillips et al. | |
| 3,020,528 | A | 2/1962 | Swanson, Jr. et al. | |
| 3,037,499 | A | 6/1962 | Cummins | |
| 3,244,168 | A | 4/1966 | Bayard | |
| 3,268,916 | A | 8/1966 | Hix, Jr. | |
| 3,322,117 | A | 5/1967 | McCaw | |
| 3,416,163 | A | 12/1968 | Jordan | |
| 3,455,296 | A | 7/1969 | McCaleb | |
| 3,517,396 | A | 6/1970 | Wert | |
| 3,520,005 | A | 7/1970 | Downes | |
| 3,639,922 | A | 2/1972 | Samuels et al. | |
| 3,691,980 | A * | 9/1972 | Shastal | A47K 11/04 116/67 R |
| 3,900,908 | A | 8/1975 | Stump | |
| 4,023,151 | A | 5/1977 | Markham | |
| 4,064,376 | A | 12/1977 | Yamada | |
| 4,155,127 | A | 5/1979 | Seiderman | |
| 4,159,714 | A | 7/1979 | Peterson | |
| 4,162,490 | A * | 7/1979 | Fu | G09B 19/0076 340/573.1 |
| 4,288,789 | A | 9/1981 | Molinick et al. | |
| 4,383,241 | A | 5/1983 | Kojima et al. | |
| 4,451,940 | A | 6/1984 | Grunz | |
| 4,521,919 | A * | 6/1985 | Molloy | H04B 1/08 116/67 R |

(Continued)

*Primary Examiner* — Lori Baker
(74) *Attorney, Agent, or Firm* — King & Partners, PLC

(57) ABSTRACT

A toilet seat assembly including: a toilet seat, at least one seat bumper positioned on the lower surface of the toilet seat an aperture, a housing, proximity sensor, wherein the proximity sensor provides a distance input signal having a value corresponding to the distance of an object from the proximity sensor, a microcontroller positioned within the housing, wherein the microcontroller is responsive to the value of the distance input signal to control audio output to a speaker, a speaker, wherein the speaker is controlled by the microcontroller for providing audio output; and an energy source, wherein the energy source is contained within the internal chamber of the housing, and wherein the energy source is in electrical communication with at least one of the proximity sensor, the microcontroller, and the speaker.

1 Claim, 8 Drawing Sheets

(56) References Cited

U.S. PATENT DOCUMENTS 4,539,559 A 9/1985 Kelly et al.
4,692,951 A 9/1987 Taki et al.
4,702,342 A 10/1987 Hale
4,735,357 A 4/1988 Greory
4,756,030 A 7/1988 Juliver
4,757,542 A 7/1988 Neahr, II et al.
4,816,809 A 3/1989 Kim
4,868,888 A 9/1989 Dayton
4,883,749 A 11/1989 Robert et al.
4,916,613 A 4/1990 Lange et al.
4,920,583 A * 5/1990 Hough ..... A47K 13/24 4/234
4,931,938 A 6/1990 Hass
4,945,943 A 8/1990 Cogger
5,008,964 A 4/1991 Dean et al.
5,025,516 A 6/1991 Wilson
5,031,258 A 7/1991 Shaw
5,032,992 A 7/1991 Bergmann
5,074,520 A 12/1991 Lee et al.
5,092,560 A 3/1992 Chen
5,095,941 A 3/1992 Betz
5,095,945 A 3/1992 Jensen
5,125,433 A 6/1992 DeMoss
5,184,642 A 2/1993 Powell
5,212,816 A 5/1993 Gimenez et al.
5,243,717 A 9/1993 Yasuo
5,253,375 A * 10/1993 Prosper ..... A47K 13/00 4/353
5,309,940 A 5/1994 Delabie
5,397,099 A 3/1995 Pillolla
5,435,018 A 7/1995 Nishimoto
RE35,018 E 8/1995 Homan
5,458,147 A 10/1995 Mauerhofer
5,465,422 A * 11/1995 Dean ..... H04W 52/0254 4/237
5,504,950 A * 4/1996 Natalizia ..... E03C 1/057 137/625.41
5,577,660 A 11/1996 Hansen
5,586,746 A 12/1996 Humpert et al.
5,703,567 A * 12/1997 Cleveland ..... G08B 21/24 340/573.1
5,748,096 A * 5/1998 Kaufer ..... A47K 13/24 340/686.1
5,755,262 A 5/1998 Pilolla
5,771,923 A 6/1998 Peterson et al.
5,867,848 A 2/1999 Ort
5,868,311 A 2/1999 Cretu-Petra
5,894,611 A * 4/1999 Toro ..... A47K 3/001 340/616
5,926,099 A * 7/1999 Unum ..... A47K 13/24 200/61.52
5,978,975 A * 11/1999 Asskaryar ..... H04B 1/08 4/353
6,640,356 B1 11/2003 Hans
7,237,278 B1 * 7/2007 Scott ..... A47K 13/24 4/483
8,175,318 B2 * 5/2012 Pieklik ..... H04R 1/028 381/387
2002/0044103 A1 4/2002 Paulson
2003/0078966 A1 4/2003 Kinjo
2004/0143893 A1 * 7/2004 Wu ..... A47K 11/02 4/319
2005/0199843 A1 * 9/2005 Jost ..... E03C 1/057 251/129.04
2008/0040845 A1 2/2008 Shoshan
2008/0098509 A1 * 5/2008 Kantor ..... A61H 33/0087 4/541.1
2009/0235441 A1 * 9/2009 Spadola ..... E03D 9/052 4/213
2010/0218306 A1 * 9/2010 Krazinsky ..... A47K 13/24 4/240
2011/0139282 A1 6/2011 Loeck et al.
2012/0144569 A1 * 6/2012 Kodat ..... E03D 9/005 4/222
2012/0233766 A1 * 9/2012 Homan ..... A47K 3/122 4/573.1
2013/0263366 A1 * 10/2013 Prete ..... A47K 13/307 4/213
2015/0211222 A1 * 7/2015 Perotto ..... E03D 9/052 4/213

* cited by examiner

TOILET SEAT ASSEMBLY

CROSS-REFERENCE TO RELATED APPLICATIONS

This application claims the benefit of U.S. Provisional Application Ser. No. 61/791,756, filed Mar. 15, 2013, entitled "TOILET SEAT ASSEMBLY," which is hereby incorporated herein by reference in its entirety, including all references cited therein.

BACKGROUND OF THE INVENTION

1. Field of the Invention

The present invention relates in general to a toilet seat and, more particularly, to a toilet seat assembly which generates sounds and/or plays messages when a user is sitting on the seat.

2. Background Art

In recent years, seats have been adopted to provide various functions in addition to their basic seating function. Toilet seats, for example, have been designed to provide features which increase the comfort of the user. One particular type of toilet seat commonly referred to as a cushioned toilet seat, is disclosed in U.S. Pat. No. 4,451,940 entitled "Toilet Seat and Cover Assembly."

Another type of toilet seat, disclosed in U.S. Pat. No. 4,920,583 entitled "Vibrating Toilet Seat," is a toilet seat wherein a vibrating motor is placed within a cushioned toilet seat and which is designed to vibrate when the user sits on the seat.

Yet another type of toilet seat, disclosed in U.S. Pat. No. 5,008,964 entitled "Child's Toilet," is a child's toilet which is a small toilet trainer or potty chair as they are more commonly known, designed to play a tune when a child sits on the seat. The child's toilet provides a small seat to suit the small physical size of children, but does not provide the capability to be used on a standard toilet by an adult.

A type of audio device designed to be used with a standard toilet is disclosed in U.S. Pat. No. 4,521,919 entitled "Bathroom Radio." However, this reference provides a device in the shape of an animal which is located externally of the toilet and which is actuated when the toilet seat is raised.

While the above-identified patents do appear to disclose toilet seats and/or audio devices, their configurations remain non-desirous and/or problematic inasmuch as, among other things, none of the above-identified toilet seats appear to be readily mountable to a conventional residential and/or commercial toilet which can generate sounds (e.g., flatulent sounds, gagging sounds, etcetera) and/or plays messages (e.g., obnoxious novelty messages) when a user is sitting on the seat.

It is therefore an object of the present invention to provide a toilet seat, which, among other things, remedies the aforementioned detriments and/or complications associated with the use of the above-identified seats and/or audio devices.

These and other objects of the present invention will become apparent in light of the present specification, claims, and drawings.

SUMMARY OF THE INVENTION

The present invention is directed to a toilet seat assembly releasably mountable to a toilet having a bowl and an upper surface comprising, consisting essentially of and/or consisting of: (a) a toilet seat hingedly positionable between a lowered position and a raised position comprising: (1) an upper surface, wherein the upper surface is adapted to support a person in a seated position thereon; (2) a lower surface, wherein the lower surface is adapted to contain at least one seat bumper; (3) at least one seat bumper positioned on the lower surface of the toilet seat, wherein the at least one seat bumper contacts the upper surface of the toilet while the toilet seat is in a lowered position, and further wherein the at least one seat bumper does not contact the upper surface of the toilet while the toilet seat is in a raised position; (4) at least one mounting member, wherein the at least one mounting member releasably mounts the toilet seat assembly to the upper surface of the toilet; and (5) an aperture, wherein the aperture provides access to the bowl of the toilet; (b) a housing positioned between the upper surface and the lower surface of the toilet seat comprising a bottom wall, at least one sidewall, an internal chamber defined by the bottom wall and the at least one sidewall of the housing; (c) a proximity sensor, wherein the proximity sensor provides a distance input signal having a value corresponding to the distance of an object from the proximity sensor; (d) a microcontroller positioned within the housing, wherein the microcontroller is responsive to the value of the distance input signal to control audio output to a speaker; (e) a speaker, wherein the speaker is controlled by the microcontroller for providing audio output; and (f) an energy source, wherein the energy source is contained within the internal chamber of the housing, and wherein the energy source is in electrical communication with at least one of a proximity sensor, a microcontroller, and a speaker.

In a preferred embodiment of the present invention, the proximity sensor and/or the speaker are flush mounted with the upper surface of the toilet seat. In this embodiment, the speaker preferably comprises a substantially waterproof cover.

In another preferred embodiment of the present invention, the bottom wall of the housing is positioned above one or more of the one seat bumpers and/or is positioned substantially flush with the lower surface of the toilet seat.

In yet another preferred embodiment of the present invention, the toilet seat assembly further comprises an accelerometer switch in electrical communication with the energy source and/or the microcontroller.

In accordance with the present invention, the energy source is preferably selected from the group consisting of a primary electrochemical cell, a secondary electrochemical cell, and/or low-voltage direct current which has been converted from alternating current with a rectifier.

In a preferred embodiment of the present invention, the audio output from the speaker comprises a flatulent sound, a gagging sound, and/or one more of verbal statement, such as: "We could use a courtesy flush down here," "Call the plumber—I quit," "You think you're having a bad day," "Should I contact the Guinness Book of World records," "That either came from a 400 pound man or a gorilla," "I'm glad you are feeling better, because I feel like sh*t [expletive]," "I'm tired of getting sh*t [expletive] on by people," "Please turn on the exhaust fan," "Taking heavy fire," "You better hope you are alone in here," "Are you kidding me," "We'll keep that between the two of us," "I'm not sure I can hold all this," and combinations thereof.

In another preferred embodiment of the present invention, the microcontroller comprises a counter delay prior to controlling the audio output.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be further understood that the invention is not necessarily limited to the particular embodiments illustrated herein.

The invention will now be described with reference to the drawings wherein.

DETAILED DESCRIPTION OF THE INVENTION

Figure 1:
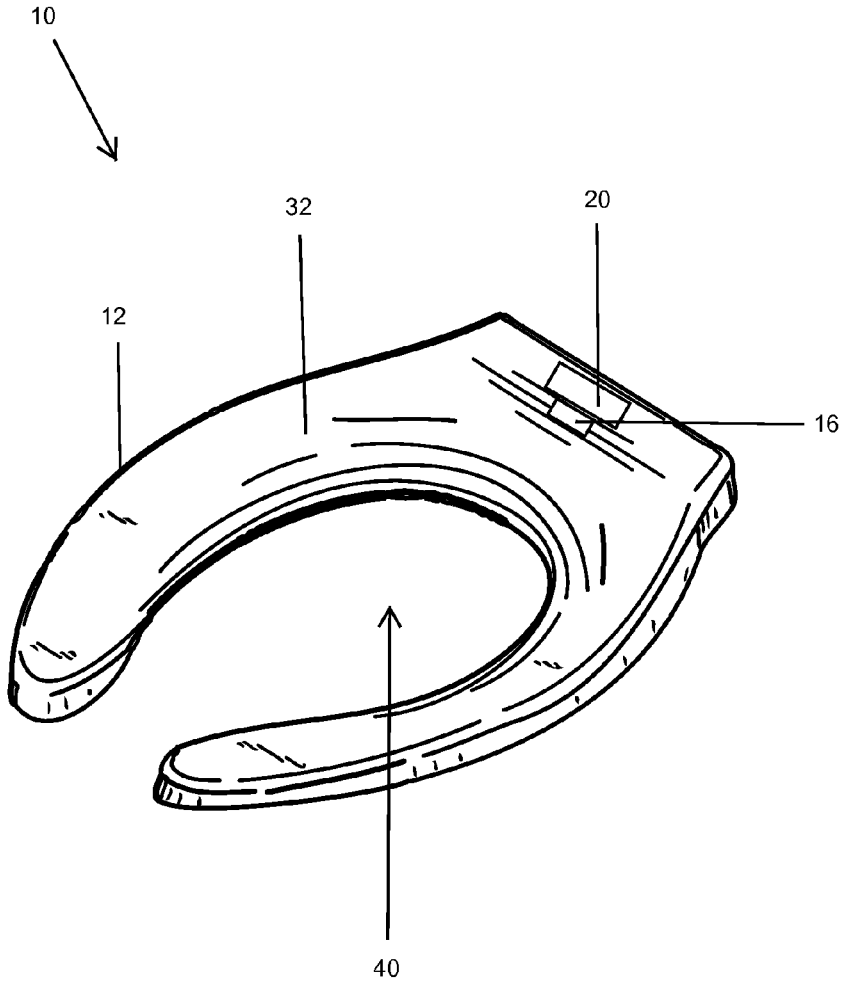
FIG. 1 of the drawings is a perspective view of a toilet seat assembly manufactured in accordance with the present invention.
Figure 2:
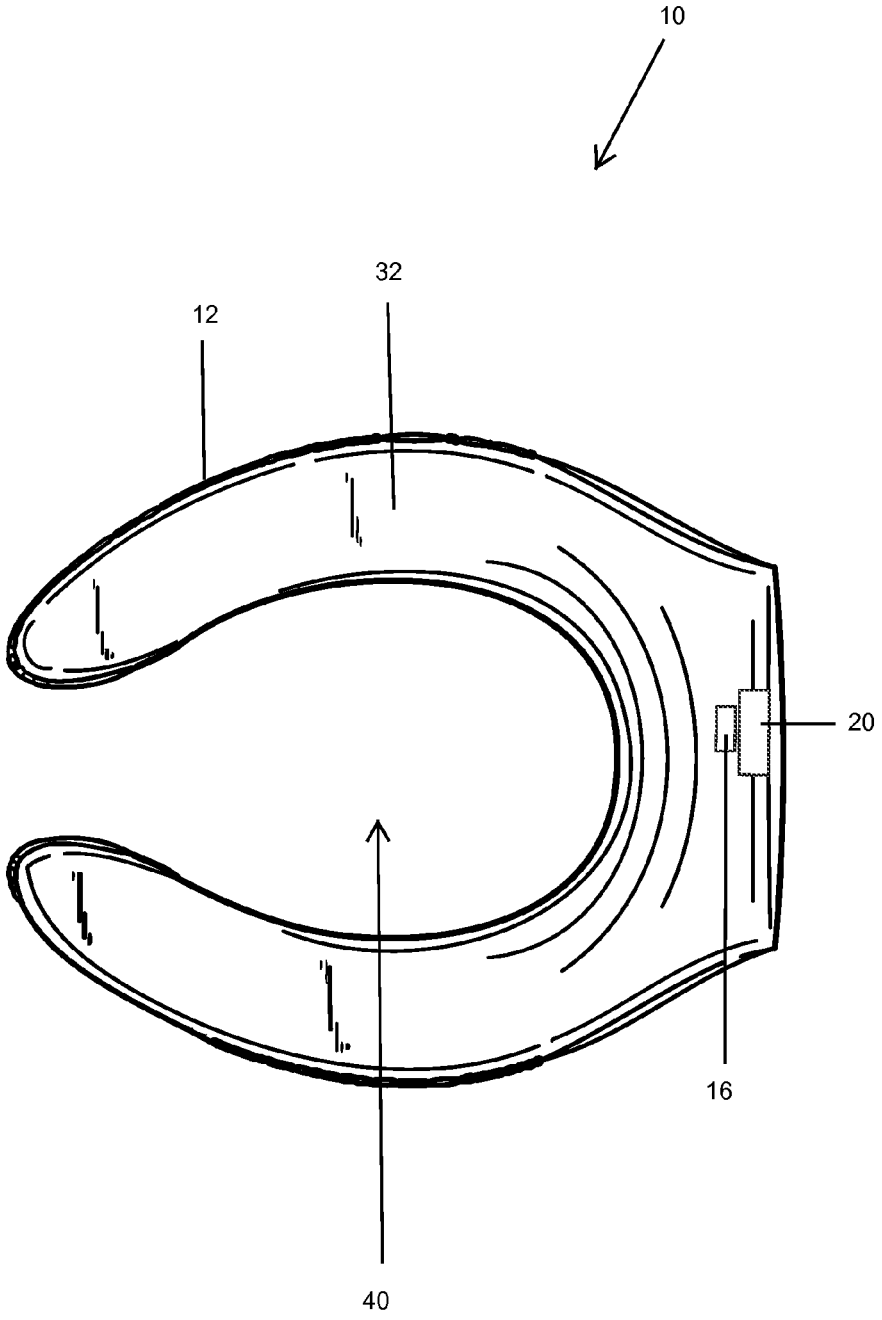
FIG. 2 of the drawings is a top plan view of a toilet seat assembly manufactured in accordance with the present invention.
Figure 3:
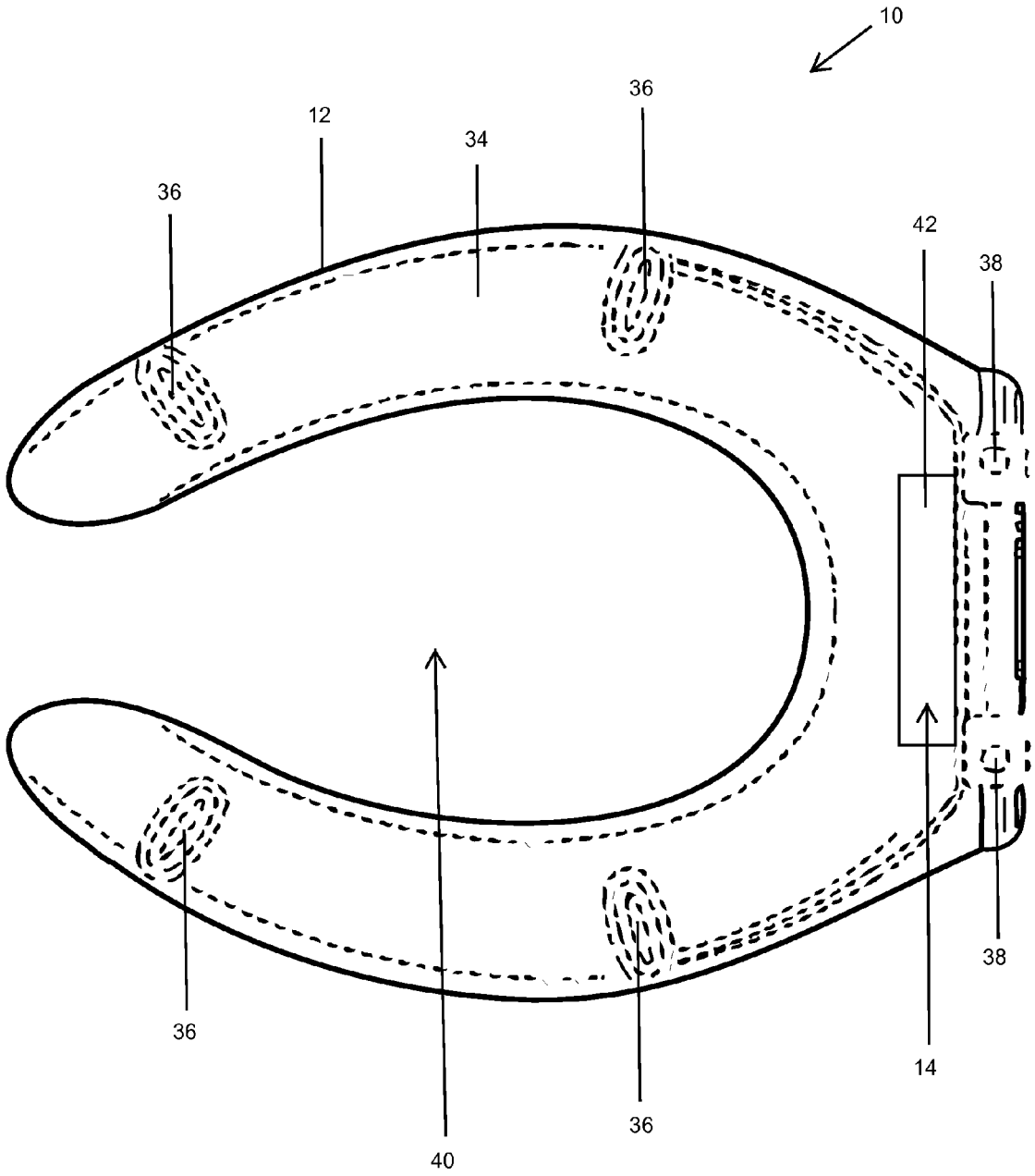
FIG. 3 of the drawings is a bottom plan view of a toilet seat assembly manufactured in accordance with the present invention.
Figure 4:
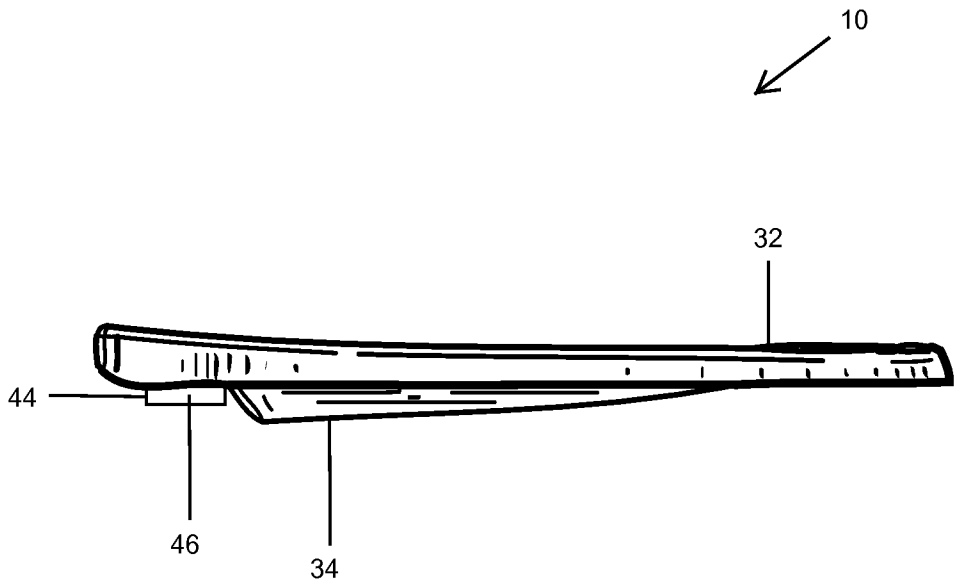
FIG. 4 of the drawings is a side elevation view of a toilet seat assembly manufactured in accordance with the present invention.
Figure 5:
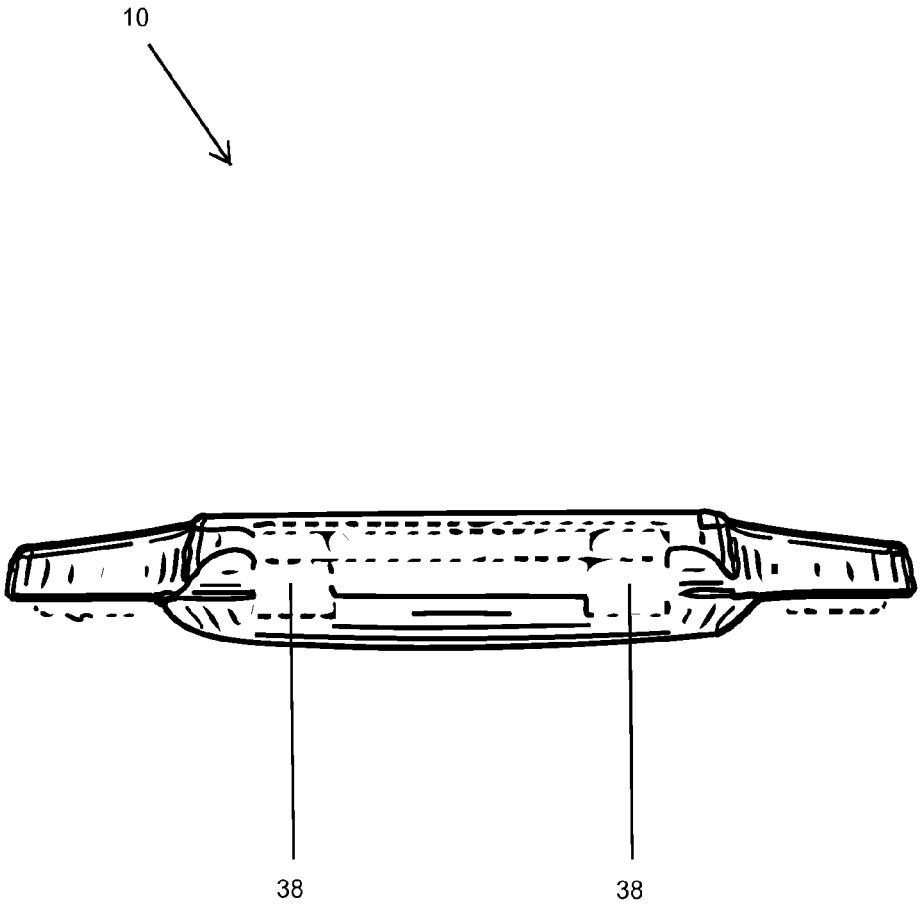
FIG. 5 of the drawings is a rear plan view of a toilet seat assembly manufactured in accordance with the present invention.
Figure 6:
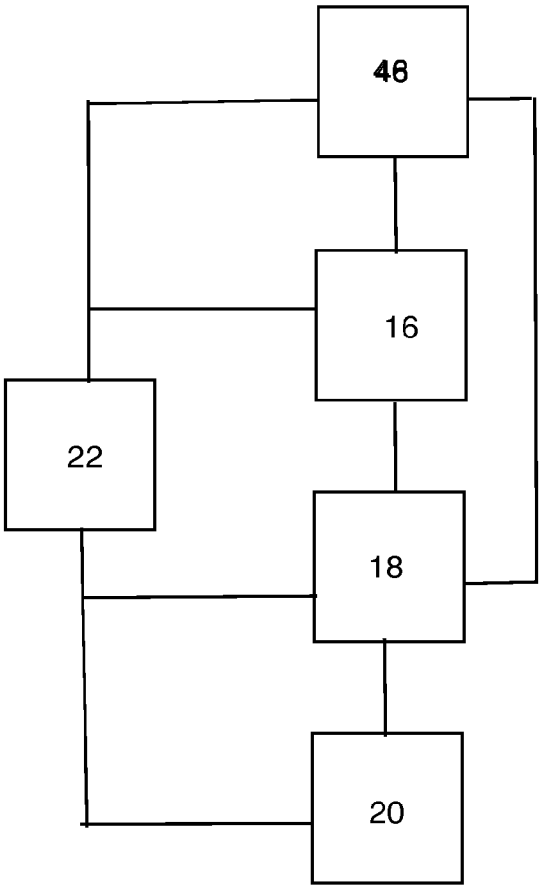
FIG. 6 of the drawings is an electrical block diagram of a toilet seat assembly manufactured in accordance with the present invention.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that for the purpose of avoiding prolix, the following patents and/or publications are hereby incorporated herein by reference in their entirety, including all references cited therein, namely: U.S. Pat. No. 6,640,356 entitled "Method for Transmitting and Evaluating Advertising and Information in Toilet Facilities and a Display Arrangement for Carrying out Said Method in a Urinal or Toilet Area," U.S. Pat. No. 5,868,311 entitled "Water Faucet with Touchless Controls," U.S. Pat. No. 5,465,422 entitled "Seat Apparatus for Actuating an Audio Source," U.S. Pat. No. 5,008,964 entitled "Child's Toilet," U.S. Pat. No. 4,920,583 entitled "Vibrating Toilet Seat," U.S. Pat. No. 4,521,919 entitled "Bathroom Radio," U.S. Pat. No. 4,451,940 entitled "Toilet Seat and Cover Assembly," United States Patent Application Publication Number 2011/0139282 entitled "Touchless Faucet Assembly and Method of Operation," and United States Patent Application Publication Number 2008/0040845 entitled "Exhibiting Device for Advertisements."

It will be understood that like or analogous elements and/or components, referred to herein, may be identified throughout the drawings with like reference characters. It will be further understood that FIGS. 1-8 are merely schematic representations of toilet seat assemblies. As such, some of the components have been distorted from their actual scale for pictorial clarity.

Referring now to the drawings and to FIGS. 1-6 in particular, toilet seat assembly 10 is disclosed which generally comprises toilet seat 12, housing 14, sensor 16, microcontroller 18, speaker 20, and energy source 22. It will be understood that while toilet seat 12 has been disclosed, for illustrative purposes only, as comprising an open, elongated seat, other configurations are likewise contemplated for use, including, but not limited to, open, closed, round, elongated and combinations thereof. It will be further understood that toilet seat 12 is non-cushioned and preferably fabricated from natural and/or synthetic plastic resins, woods, metals, metal alloys, just to name a few. As will be discussed in greater detail herein below the toilet seat assemblies of the present invention are intended to be used as novelty items, gag gifts, and the like.

Figure 7:
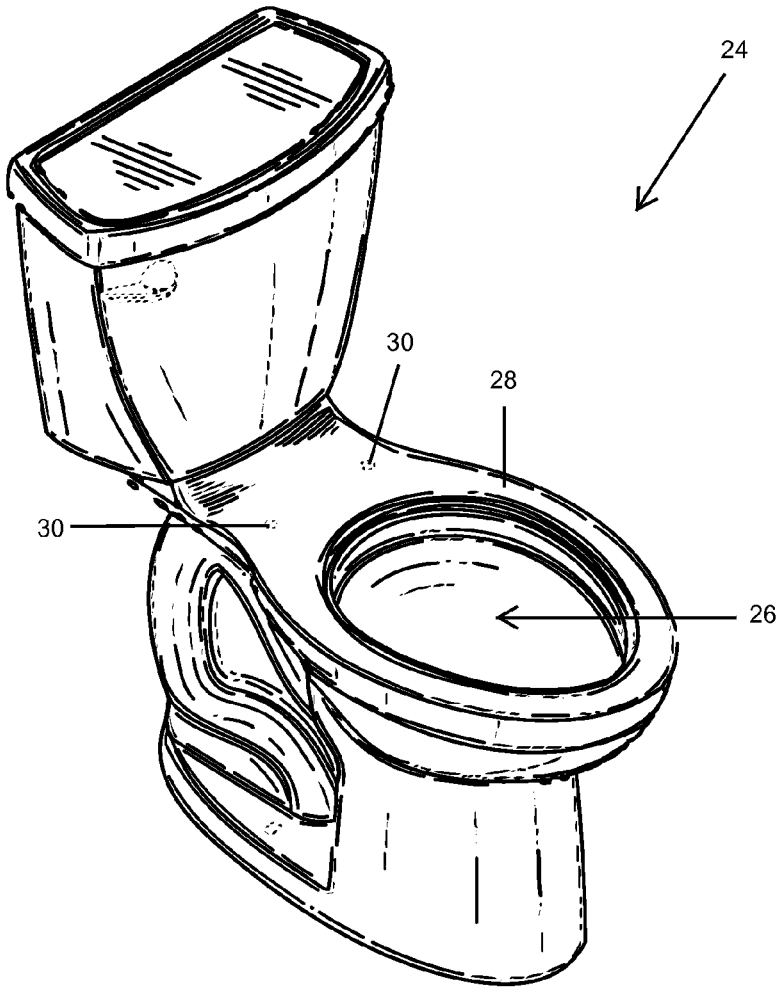
FIG. 7 of the drawings is a perspective view of a prior art toilet for use in association with the toilet seat assembly manufactured in accordance with the present invention.

As is shown in FIG. 7, toilet seat assembly 12 is releasably mountable to a conventional residential and/or commercial toilet 24 having a bowl 26, an upper surface 28, and mounting apertures 30. It will be understood that toilet 24 may comprise a one-piece toilet, a two-piece toilet, and/or a multi-piece toilet that includes a tank and/or is tankless.

Referring once again to FIGS. 1-7, toilet seat 12 of toilet seat assembly 10 is hingedly positionable between a lowered position and a raised position and includes upper surface 32 which is adapted to support a person in a seated position thereon (e.g., when going to the bathroom), lower surface 34 which is adapted to contain one or more seat bumpers 36. Seat bumpers 36 are positioned on lower surface 34 of toilet seat 12 and preferably contact upper surface 28 of toilet 24 while toilet seat 12 is in a lowered position. It will be understood that seat bumpers 36 do not contact upper surface 28 of toilet 24 while toilet seat 12 is in a raised position.

Toilet seat 12 also includes one or more mounting members 38 (e.g., brackets), which releasably mount toilet seat assembly 10 to upper surface 28 of toilet 24. In particular, fasteners, such as threaded bolts, secure toilet seat 12 to toilet 24 by way of mounting apertures 30 which are aligned with mounting members 38.

Aperture 40 provides a user access to bowl 26 of toilet 24 during normal use, such as while going to the bathroom, vomiting, etcetera.

Housing 14 is preferably positioned between upper surface 32 and lower surface 34 of toilet seat 12 and comprises bottom wall 42 and one or more sidewalls 44. Internal chamber or region 46 is defined by bottom wall 42 and one or more sidewalls 44.

Housing 14 preferably contains sensor 16, microcontroller 18, speaker 20, and energy source 22. In one embodiment, bottom wall 42 of housing 14 is positioned above one or more of seat bumpers 36. Additionally, bottom wall 42 of housing 14 is positioned substantially flush with lower surface 34 of toilet seat 12.

In accordance with the present invention sensor 16 preferably includes a proximity sensor which provides a distance input signal having a value corresponding to the distance of an object (e.g., a person approach the toilet for use) from the proximity sensor. In additional embodiments, sensor 16 comprises a light sensor (e.g., infrared and/or other wavelengths of the electromagnetic spectrum) or a pressure sensor having a trigger pin which contacts the upper surface of the toilet when a person sits on toilet seat 12. In one embodiment, the proximity sensor is flush mounted with upper surface 32 of toilet seat 12.

Microcontroller 18 is preferably positioned within housing 14 and is responsive to the value of the distance input signal from sensor 16 to control audio output to speaker 20. It will be understood that microcontroller 18 preferably is microcomputer based and has a memory that stores a control program which governs operation of toilet seat assembly 10 and stores data used by that control program. In one embodiment microcontroller 18 comprises an integrated circuit chip providing a microprocessor, programmable memory (PROM), erasable memory (RAM), analog to digital converting means and/or other logic operations. Preferably, microcontroller 18 comprises a Motorola M68XXXX series chip, such as a M68HC11 chip. It will be understood that other microcontroller that would be known to those having ordinary skill in the art with the present disclosure before them are likewise contemplated for use. Additional exemplary computing configurations that may be utilized in accordance with the present invention are described in greater detail relative to FIG. 8.

In one embodiment microcontroller 18 includes a counter delay prior to controlling the audio output. Such a counter delay may be randomized and/or selected from a predetermined amount of time such as, one second, 15 seconds, one minute, two minutes, etcetera.

Speaker 20 is controlled by microcontroller 18 for providing audio output. Examples of audio output stored in memory of microcontroller 18 include, for example, a flatulent sound, a gagging sound, and/or one of more of the following verbal statements, namely: "We could use a courtesy flush down here," "Call the plumber—I quit," "You think you're having a bad day," "Should I contact the Guinness Book of World records," "That either came from a 400 pound man or a gorilla," "I'm glad you are feeling better, because I feel like sh*t [expletive]," "I'm tired of getting sh*t [expletive] on by people," "Please turn on the exhaust fan," "Taking heavy fire," "You better hope you are alone in here," "Are you kidding me," "We'll keep that between the two of us," "I'm not sure I can hold all this," and combinations thereof.

According to one embodiment of the present invention, microcontroller 18 may select the verbal statement based upon the value corresponding to the distance. Because the value corresponding to the distance for each person may vary, a different verbal statement may be selected for each individual. For example, a heavier individual may generate a larger distance value than a relatively lighter person. Microcontroller 18 may select the verbal statement based upon this value. In some instances, an embarrassing verbal statement may be chosen if the value corresponding to the distance is relatively large compared to the other distance values received by microcontroller 18.

Preferably speaker 20 is flush mounted with upper surface 32 of toilet seat 12 and/or comprises a substantially waterproof cover to prevent fluids, such as urine and/or vomit from adversely affecting the performance and longevity of the speaker.

Energy source 22 is preferably contained within internal chamber 46 of housing 14, and is in electrical communication with one or more of sensor 16, microcontroller 18, and speaker 20. In a preferred embodiment of the present invention, energy source 22 is selected from the group consisting of a primary electrochemical cell, a secondary electrochemical cell, low-voltage direct current which has been converted from alternating current with a rectifier, and combinations thereof.

In one embodiment of the present invention, accelerometer switch 48 is optionally included which is in electrical communication with one or more of energy source 22 and microcontroller 18. Accelerometer switch 48 serves as an on/off switch. In particular, when toilet seat 12 is raised accelerometer switch 48 provides an off signal, and when toilet seat 12 is lowered accelerometer switch 48 provides an on signal—thereby conserving energy and extending battery life for certain embodiments.

In operation, a person approaches toilet seat assembly 10 mounted on toilet 24. When the person is within a predetermined distance and the toilet seat is down, a delay counter is preferably initiated by microcontroller 18. After a period of time, the microcontroller provides an audio signal to the speaker which is intended embarrass, disturb, confuse, and/or bring upon laughter to the person. Indeed, toilet seat assembly 10 is a novelty item appropriate for parties, sporting events—just to name a few.

Figure 8:
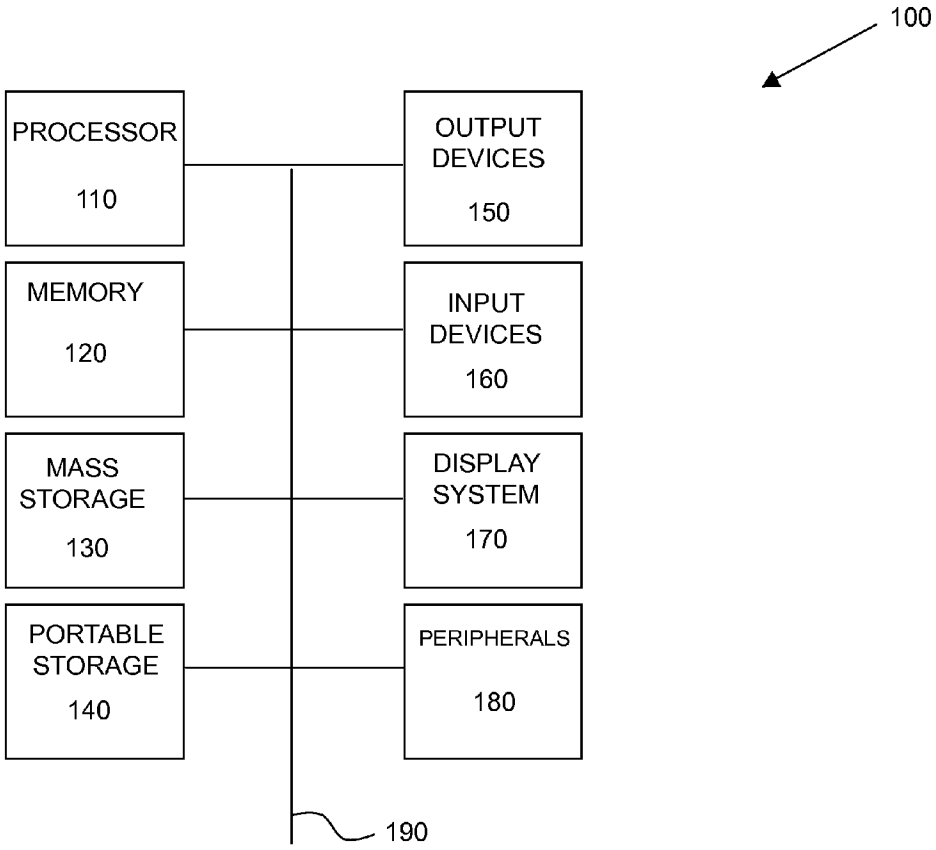
FIG. 8 of the drawings illustrates an exemplary computing device that may be used to implement embodiments according to the present technology.

FIG. 8 illustrates an exemplary computing device/system 100 that may be used to implement the various embodiments of the present technology. Computing device 100 of FIG. 8 includes one or more processors 110 and memory 120. Memory 120 stores, in part, instructions and data for execution by processor 110. Memory 120 can store the executable code when system 100 is in operation. System 100 of Figure preferably further includes mass storage device 130, portable storage medium drive(s) 140, output devices 150, user input devices 160, graphics display 170, and peripheral devices 180.

While the components shown in FIG. 8 are depicted as being connected via single bus 190, they may also be connected through one or more data transport means. Processor unit 110 and main memory 120 may be connected via a local microprocessor bus, and mass storage device 130, peripheral device(s) 180, portable storage device 140, and display system 170 may be connected via one or more input/output (I/O) buses.

Mass storage device 130, which may be implemented with a magnetic disk drive or an optical disk drive, is a non-volatile storage device for storing data and instructions for use by processor unit 110. Mass storage device 130 can store the system software for implementing embodiments of the present invention for purposes of loading that software into memory 120.

Portable storage device 140 operates in conjunction with a portable non-volatile storage medium, such as a floppy disk, compact disk, digital video disc, or USB storage device, to input and output data and code to and from computer device/system 100 of FIG. 8. The system software for implementing embodiments of the present invention may be stored on such a portable medium and input to computer system 100 via portable storage device 140.

Input devices 160 provide a portion of a user interface. Input devices 160 may include an alpha-numeric keypad, such as a keyboard, for inputting alpha-numeric and other information, or a pointing device, such as a mouse, a trackball, stylus, or cursor direction keys. Additionally, system 100 as shown in FIG. 8 includes output devices 150. Suitable output devices include speakers, printers, network interfaces, and monitors.

Display system 170 may include a liquid crystal display (LCD) or other suitable display device. Display system 170 receives textual and graphical information, and processes the information for output to the display device.

Peripherals 180 may include any type of computer support device to add additional functionality to the computer system. Peripheral device(s) 180 may include, for example, a modem or a router.

The components contained in computing device/system 100 of FIG. 8 are those typically found in computing devices that may be suitable for use with embodiments of the present invention and are intended to represent a broad category of such computer components that are well known in the art. Thus, computing device/system 100 of FIG. 8 may be a personal computer, hand held computing device, telephone, mobile computing device, workstation, server, minicomputer, mainframe computer, or any other type of computing device. The computer may also include different bus configurations, networked platforms, multi-processor platforms, etc. Various operating systems can be used including Unix, Linux, Windows, Macintosh OS, Palm OS, Android, iPhone OS and other suitable operating systems.

Some of the above-described functions may be composed of instructions that are stored on storage media (e.g., computer-readable medium). The instructions may be retrieved and executed by the processor. Some examples of storage media are memory devices, tapes, disks, and the like. The instructions are operational when executed by the processor to direct the processor to operate in accord with the technology. Those skilled in the art are familiar with instructions, processor(s), and storage media.

It is noteworthy that any hardware platform suitable for performing the processing described herein is suitable for use with the technology. The terms "computer-readable storage medium" and "computer-readable storage media" as used herein refer to any medium or media that participate in providing instructions to a central processing unit (CPU), a processor, a microcontroller, or the like. Such media can take forms including, but not limited to, non-volatile and volatile media and transmission media. Non-volatile media include, for example, optical or magnetic disks, such as a fixed disk. Volatile media include dynamic memory, such as system RAM. Transmission media include coaxial cables, copper wire and fiber optics, among others, including the wires that comprise one embodiment of the bus. Transmission media can also take the form of acoustic or light waves, such as those generated during radio frequency (RF) and infrared (IR) data communications. Common forms of computer-readable media include, for example, a floppy disk, a flexible disk, a hard disk, magnetic tape, and other magnetic medium, a CD-ROM disk, digital video disk (DVD), any other optical medium, any other physical medium with patterns of marks or holes, a RAM, a PROM, an EPROM, an EEPROM, and FLASHEPROM, any other memory chop or data exchange adapter, a carrier wave, or any other medium from which a computer can read.

The foregoing description merely explains and illustrates the invention and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A toilet seat assembly releasably mountable to a toilet having a bowl and an upper surface, consisting of:

a toilet seat hingedly positionable between a lowered position and a raised position comprising:

an upper surface, wherein the upper surface is adapted to support a person in a seated position thereon;

a lower surface, wherein the lower surface is adapted to contain at least one seat bumper;

at least one seat bumper positioned on the lower surface of the toilet seat, wherein the at least one seat bumper contacts the upper surface of the toilet while the toilet seat is in a lowered position, and further wherein the at least one seat bumper does not contact the upper surface of the toilet while the toilet seat is in a raised position;

at least one mounting member, wherein the at least one mounting member releasably mounts the toilet seat assembly to the upper surface of the toilet;

an aperture, wherein the aperture provides access to the bowl of the toilet;

a housing positioned between the upper surface and the lower surface of the toilet seat comprising a bottom wall, at least one sidewall, an internal chamber defined by the bottom wall and the at least one sidewall of the housing;

a proximity sensor, wherein the proximity sensor provides a distance input signal having a value corresponding to the distance of an object from the proximity sensor;

a microcontroller positioned within the housing, wherein the microcontroller is responsive to the value of the distance input signal to control audio output to a speaker;

a speaker, wherein the speaker is controlled by the microcontroller for providing audio output; and an energy source, wherein the energy source is contained within the internal chamber of the housing, and wherein the energy source is in electrical communication with at least one of a proximity sensor, a microcontroller, and a speaker.

* * * * *